United States Patent [19]

Shephard

[11] 4,270,418

[45] Jun. 2, 1981

[54] FLUTED TOOL

[75] Inventor: Donald L. Shephard, Port Huron, Mich.

[73] Assignee: Helen I. Shephard, Port Huron, Mich. ; a part interest

[21] Appl. No.: 102,927

[22] Filed: Dec. 12, 1979

[51] Int. Cl.[3] ..... B25B 13/02

[52] U.S. Cl. ..... 81/90 D; 81/441

[58] Field of Search ..... 81/3.48, 71, 90 D, 121 A

[56] References Cited

U.S. PATENT DOCUMENTS

| | | | |
|---|---|---|---|
| 2,445,905 | 7/1948 | Busby | 81/90 D X |
| 2,619,861 | 12/1952 | Wanamaker | 81/90 D |

FOREIGN PATENT DOCUMENTS

| | | | |
|---|---|---|---|
| 57616 | 4/1921 | Sweden | 81/90 D |

*Primary Examiner*—James G. Smith

*Attorney, Agent, or Firm*—Cullen, Sloman, Cantor, Grauer, Scott, & Rutherford

[57] ABSTRACT

A tool for removing bungs and screws comprises a shank adapted for connection to a rotated drive and an enlarged head with transverse axial slots formed therethrough and an axial threaded bore defining a plurality of flutes. Each flute has a first flat axial side with a radial outer edge inclined outwardly toward the shank at an acute angle. The radial edge terminates in a flat relief surface extending at an increased acute angle toward the shank, and terminates in a flat clearance surface extending at a further increased angle. The relief surface terminates in a second flat axial side arranged at at least a 90 degree angle to the first flat side.

17 Claims, 7 Drawing Figures

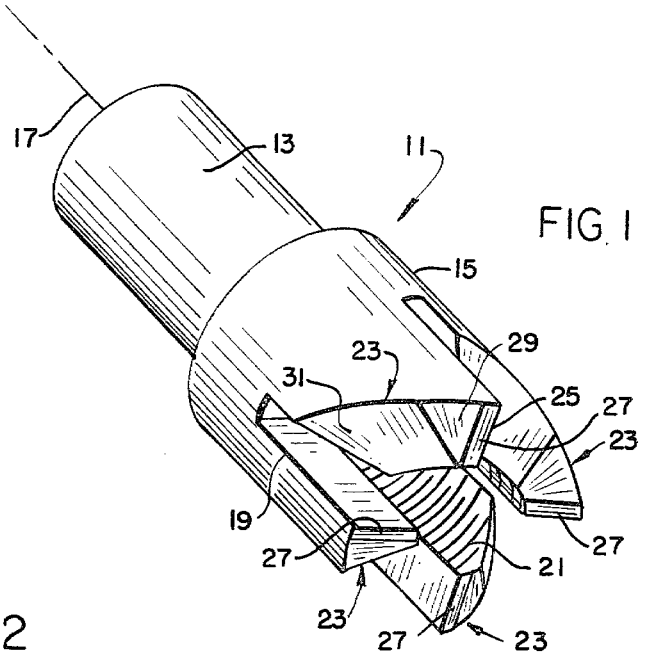
FIG. 1
FIG. 2
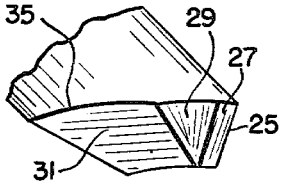
FIG. 3
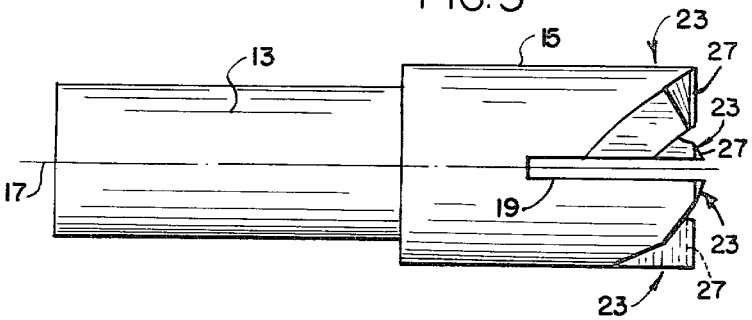
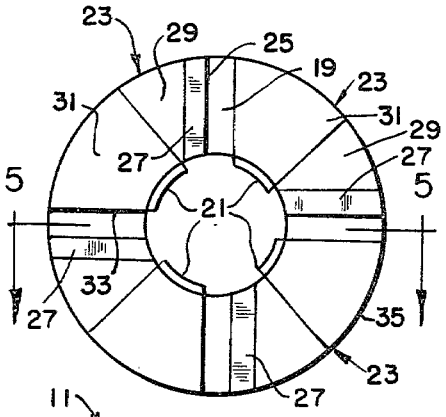
FIG. 4
FIG. 6
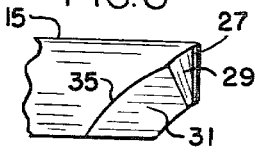
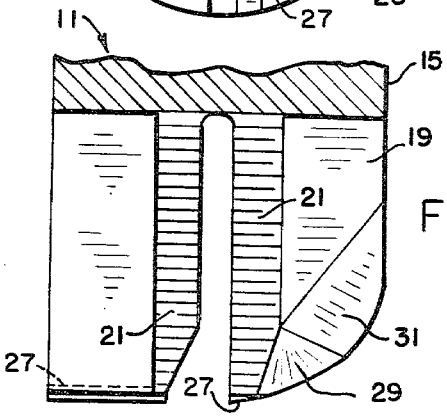
FIG. 5
FIG. 7
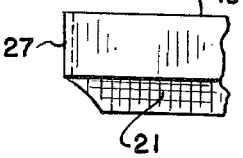

FLUTED TOOL

BACKGROUND OF THE INVENTION

There is long existed a need for a power driven rotated tool adapted for removing bungs and screws.

SUMMARY OF THE INVENTION

Present invention is directed to the fluted tool and more particularly to a tool adapted for removing bungs and screws. The tool comprises a cylindrical shank of a predetermined diameter having a longitudinal axis and which is adapted for connection adjacent one end to a rotated power drive. A cylindrical head of increased diameter extends axially of its other end, there being transverse axial longitudinal slots through said head and an axially interiorly threaded bore defining a plurality of right angularly related flexible flutes. The flutes each have a first flat axial side extending substantially the length of the slot with a radial top edge at its end, inclined outwardly and toward said shank at an acute angle. The radial edge terminates in a flat relief surface extending at in increased acute angle toward said shank. The relief surface terminates in a flat clearance surface extending in a further increased angle towards said shank. The relief surface terminates in a further axial flat side arranged at at least right angles to the first flat side.

It is a further object to provide a multiple fluted tool, which in view of the axial bore and the slots therein defining said flutes render the said flutes flexible.

It is an object of the present invention to provide a multiple fluted tool, particularly adapted for removal of bungs and screws and wherein each flute is defined by a series of interconnected acute angularly related surfaces which include a relief surface and a clearance surface and wherein the slots which define said flutes provide flat axial edges for the flute and wherein said edges are arranged at at least 90 to 120 degrees with respect to each other and wherein the respective flutes are symmetrical and arranged in a circle and wherein the outer surfaces of each flute are arcuate.

These and other objects will be seen in the following specification and claims in conjunction with the apended drawing.

THE DRAWING

FIG. 1 is a perspective view of the present fluted tool.

FIG. 2 is a perspective view of one of the flutes thereof.

FIG. 3 is a side view of the tool.

FIG. 4 is an end view of the tool.

FIG. 5 is a section taken in the direction of arrows 5—5 of FIG. 4.

FIG. 6 is a side view of the flute shown in FIG. 2.

FIG. 7 is a side view of the flute shown in FIG. 2, taken in the direction of right angles from the view shown in FIG. 6.

It will be understood that the above drawing illustrates merely a preferred embodiment of the invention, and that other embodiments are contemplated within the scope of the claims hereafter set forth.

DETAILED DESCRIPTION OF THE INVENTION

The present fluted tool generally designated at 11 in FIG. 1 is particularly adapted for removing bungs and screws and for counterbores though not limited thereto. The present tool comprises a cylindrical shank 13 of a predetermined diameter and having at one end the cylindrical head 15 of an increased diameter. Both the shank and head having a longitudinal central axis designated at 17.

The shank adjacent one end is adapted for connection to a rotated power drive. The cylindrical head extends axially of the other end of the shank and includes a series of circularly arranged symmetrical flutes 23.

Formed through the head longitudinally thereof are at least a pair of elongated axial transverse slots 19 which extend substantially the length of the head. Axially of the head there is provided elongated interiorally threaded or tapped bore 21.

Said bore and the respective transverse elongated axial slots 19 defined within the head a series of symmetrical spaced circularly arranged flutes 23 as in FIG. 4.

Each flute includes a first flat axial side 25 defined by slot 19 which side extends substantially the length of the slot within said head. The elongated flat side 19 terminates at its outer end in the radial edge 27. Said edge as shown in FIG. 3 projects outwardly and is inclined toward said shank at an acute angle in the range of 10 degrees, approximately. Said acute angle is measured from a plane extending transversly of the longitudinal axis 17 and through a straight line on the high side of the top edge 27, at the end of the flat side 25. The radial edge terminates in a flat relief surface 29 which is generally triangular in shape which is inclined at an acute angle in the range of 40 degrees, approximately, with respect to said transverse plane.

Said relief surface terminates in a flat clearance surface 31 which extends in a further increased acute angle and is inclined toward said shank. The relief surface 29 and the clearance surface 31 have an arcuate outer edge as shown at 35 with inner edge portions thereof also being arcuate and threaded or tapped as at 21.

The clearance surface 31 terminates in the second axial flat side 33 further defined by one of the slots 19. The second flat side 33 in the illustration shown in FIG. 4 extends at right angles to the first flat side 25 of the flute 23. It is contemplated that in the event, instead of four flutes as shown in FIG. 4, there is only three flutes with each flute arranged at 120 degree angle with respect to each other that in that case, the second flat side 33 would be arranged at an angle with respect to the first flat side 25 of 120 degrees, approximately, for illustration.

The respective transverse axial slots 19 which define the respective flutes, and in conjunction with the tapped or threaded bore 21 applied to the individual flutes renders the said flutes to a degree flexible in use upon a work piece as for example in the removing of bungs or screws or for counterboring or other functions.

The foregoing drawings are illustrative of the preferred embodiment of the invention. It is contemplated that other embodiments may be employed.

In the illustrated embodiment, the flutes 23 are defined as left hand cut and the tap 21 is a left hand tap.

In the illustrated embodiment, the tapped bore 21 extends approximately to the end of the respective axial slots 19 within head 15. This provides for increased flexibility of the respective flutes.

The invention relates to a fluted tool for the removal of wood bungs and screws. Though not specifically limited thereto, in the use of metal screws in a boat for securing one part to another, usually after the screw is in place there is a counter-sink above the head of the screw and into that counter-sink there is tapped in and secured a wood bung. This fills the counter-sink hole which is afterwards painted over so that the hole does not show.

The present tool is designed first to remove this bung and thereafter the tool is effective for removing the metal screw. Particularly in boating areas, the screw heads through electrolytic action become damaged and often times the head is broken or the slot that receives the screwdriver is so deformed that the conventional screwdriver will not effectively unthread and remove the screw.

Accordingly, once the bung has been removed, the fluted tool is further advanced so that there is a destruction of the pre-existing portions of the damaged head of the screw. After that, the fluted tool advances along the length of the screw a sufficient distance so as to firmly grip the screw and to thread it out of the hole. The fluted tool advances longitudinally over a portion of the screw until there is a tight frictional engagement and then, since this is a left hand rotation on the conventional left hand screw unthreading type, the screw is gripped and rotated until it is disconnected from whatever it was mounted on. The present tool solves the problem of removing such screws.

Having described my invention, reference should now be had to the following claims.

I claim:

1. A tool for removing bungs and screws comprising a cylindrical shank of predetermined diameter having a longitudinal central axis, adapted for connection adjacent one end to a rotatable power drive;

a cylindrical head of increased diameter extending axially of its other end;

there being transverse axial longitudinal slots through said head extending inwardly from its end for a substantial portion of its length;

and an axial interiorally threaded bore for the length of said slots defining a plurality of flexible parallel flutes;

each flute having a first flat axial side extending substantially the length of said slots;

a radial top edge at the end of said flat side inclined outwardly and toward said shank at an acute angle;

said radial edge terminating in a flat relief surface extending at an increased acute angle toward said shank;

said relief surface terminating in a flat clearance surface extending in a further increased acute angle toward said shank;

said clearance surface terminating in a second axial flat side.

2. In the tool of claim 1, each of said flutes along its length having a transverse arcuate outer surface.

3. In the tool of claim 1, the flat sides of each flute extending at right angles to each other.

4. In the tool of claim 1, said second flat side being shorter than said first flat side.

5. In the tool of claim 1, the acute angle of said radial edge being ten degrees, approximately.

6. In the tool of claim 5, the acute angle of said relief surface being forty degrees, approximately.

7. In the tool of claim 6, the acute angle of said clearance surface being greater than forty degrees.

8. In the tool of claim 1, said radial edge terminating in a straight radial line at the end of said first flat surfaces, the acute angle of said radial edge being ten degrees, approximately, relative to a plane passing through said radial line.

9. In the tool of claim 8, the acute angle of said relief surface being forty degrees, approximately, relative to said plane.

10. In the tool of claim 8, the acute angle of said clearance surface being greater than forty degrees, relative to plane.

11. In the tool of claim 1, said relief surface being generally triangular.

12. In the tool of claim 1, said clearance surface being in the form of an arcuate sector with inwardly converging ends.

13. In the tool of claim 1, the first flat side of one flute being respectively parallel to the second flat sides of adjacent flutes.

14. In the tool of claim 1, the second flat side of a flute being in alignment with the first flat side of a preceeding adjacent flute.

15. In the tool of claim 1, the first flat side of one flute extending at right angles to the first flat sides of adjacent flutes upon opposite sides thereof.

16. In the tool of claim 1, the second flat side of one flute extending at right angles to the second flat sides of adjacent flutes on opposite sides thereof.

17. A tool comprising a cylindrical shank of predetermined diameter having a longitudinal central axis, adapted for connection adjacent one end to a rotatable power drive;

a cylindrical head of increased diameter extending axially of its other end;

there being transverse axial longitudinal slots through said head and an axial interiorally threaded bore for the length of said slots defining a plurality of flexible parallel flutes;

each flute having a first flat axial side extending substantially the length of said slots;

a radial top edge at the end of said flat side inclined outwardly and toward said shank at an acute angle;

said radial edge terminating in a flat relief surface extending at an increased acute angle toward said shank;

said relief surface terminating in a flat clearance surface extending in a further increased acute angle toward said shank;

said relief surface terminating in a second axial flat side, at an angle to said first flat side in the range of 90–120 degrees.

* * * * *